US006709031B1

(12) United States Patent
Michael

(10) Patent No.: US 6,709,031 B1
(45) Date of Patent: Mar. 23, 2004

(54) WINDOW AND SLIDING GLASS DOOR HAVING PUSH BUTTON LOCKING MECHANISM

(76) Inventor: Alexander Michael, 162 Torrey Pines Dr., Toms River, NJ (US) 08757

( * ) Notice: Subject to any disclaimer, the term of this patent is extended or adjusted under 35 U.S.C. 154(b) by 0 days.

(21) Appl. No.: 10/308,381

(22) Filed: Dec. 3, 2002

(51) Int. Cl.[7] ..... E05C 1/06
(52) U.S. Cl. ..... 292/138; 292/DIG. 37
(58) Field of Search ..... 292/DIG. 37, DIG. 46, 292/32, 33, 40, 173, 143, 138

(56) References Cited

U.S. PATENT DOCUMENTS 426,765 A * 4/1890 Brunhoff
472,886 A * 4/1892 Johnson
788,515 A * 5/1905 Carlson
905,984 A * 12/1908 Buttress
1,135,696 A * 4/1915 Kentzer
2,221,110 A * 11/1940 Ross ..... 292/164
2,883,227 A * 4/1959 Hoofe ..... 292/140
5,390,516 A * 2/1995 Alchin ..... 70/100

* cited by examiner

*Primary Examiner*—Gary Estremsky

(57) ABSTRACT

A window locking mechanism or sliding door locking mechanism includes a cover having an internal compartment for receiving a push button locking assembly therein. The push button locking assembly includes a rocker lever arm sub-assembly, a locking pin, a releasing pin and a push button housing all connected together. The rocker lever arm sub-assembly includes a lever arm having a tensioning spring mounted on each outer end. The rocker lever arm sub-assembly is movable between a locking position and an unlocking position for activating the releasing pin to withdraw the locking pin from the push button housing in order to allow a pair of windows or sliding doors to be unlocked, and for activating the locking pin for insertion of the locking pin in the push button housing in order to lock a pair of windows or sliding doors in a locked position.

34 Claims, 10 Drawing Sheets

WINDOW AND SLIDING GLASS DOOR HAVING PUSH BUTTON LOCKING MECHANISM

FIELD OF INVENTION

The present invention relates to an improved window or sliding glass door having an integral push button locking mechanism. More particularly, the locking mechanism includes a rocker lever arm for inserting or retracting a locking pin in order to allow the two windows or two glass sliding doors to be locked or unlocked accordingly.

BACKGROUND OF THE INVENTION

Sliding doors and windows are often locked by complex locking mechanisms that comprise many internal moving parts and thus are subject to disrepair. Also, the frame of the windows or doors are not of a sufficient size to receive large and secure locking mechanisms. Therefore, there is a need for a mechanism to lock the windows or lock the sliding glass doors that is secure, ergonomically efficient, simple to use, and requires only a minimal number of internal moving parts to withstand everyday wear and tear.

DESCRIPTION OF THE PRIOR ART

Sliding door locks, plug-in locks, slidable door safety locks, window locking devices sliding closure locking devices, sliding door push locks and sliding door latching devices having various designs, configurations, structures and materials of construction have been disclosed in the prior art. For example, U.S. Pat. No. 3,863,470 to IMER discloses a sliding door lock for use with a pair of overlapping glass doors or windows which are slidably mounted in a pair of adjacent upper and lower tracks. The sliding door lock includes a control knob for inserting and retracting one or more locking pins. The control knob uses a cam element for inserting and retracting the one or more locking pins. This prior art patent does not teach or disclose the particular structure of a sliding door push button locking mechanism that uses a rocker lever arm for inserting or retracting a locking pin in order to allow the two windows or two glass sliding doors to be opened or closed.

U.S. Pat. Nos. 3,397,000 to NAKANISHI and 5,464,261 to ALKHOURY both disclose a sliding door lock for use with a pair of overlapping glass doors which are slidably mounted in a pair of adjacent upper and lower tracks. Each of the above sliding door locks include a control knob mounted on a spring activated locking pin. The control knob and locking pin are not spaced-apart in their respective structures as compared to the structure of the present invention. These prior art patents do not teach or disclose the particular structure of a sliding door push button locking mechanism that uses a rocker lever arm for inserting or retracting a locking pin in order to allow the two windows or two glass sliding doors to be opened or closed.

None of the prior art patents disclose or teach a sliding door locking mechanism or window locking mechanism using a control knob (lock releasing pin) and locking pin in cooperation with a rocker lever arm allowing the locking pin to open or close the two windows or two glass sliding doors.

Accordingly, it is an object of the present invention to provide a window or sliding door locking mechanism having an integrated push button locking mechanism that requires only a minimal number of internal moving component parts.

Another object of the present invention is to provide an integrated push button locking mechanism that includes a control knob or a lock releasing pin, a locking pin and a rocker lever arm, wherein the rocker lever arm is used for inserting or retracting the locking pin from one of the glass sliding door stiles in order to allow the two glass sliding doors to be opened or closed accordingly.

Another object of the present invention is to provide a sliding door locking mechanism or window locking mechanism that is capable of withstanding everyday wear and tear.

Another object of the present invention is to provide a sliding door locking mechanism or window locking mechanism having an integrated push button locking mechanism that is secure, safe, efficient, durable and easy to use.

Another object of the present invention is to provide a sliding door locking mechanism or a window locking mechanism that is easily installed without the necessity for extensive modifications of the existing windows or sliding glass doors.

Another object of the present invention is to provide for a sliding door locking mechanism that prevents the panels of the glass siding doors from sliding horizontally relative to each other in their respective tracks.

Another object of the present invention is to provide a sliding door locking mechanism that is aesthetically pleasing and unobtrusive when mounted on the vertical stile of one of the sliding glass doors.

Another object of the present invention is to provide a sliding door locking mechanism or a window locking mechanism that is rapidly locked and unlocked to a closed or opened position.

Another object of the present invention is to provide a sliding door locking mechanism that is permanently mounted on the vertical stile using a minimum number of tools.

A further object of the present invention is to provide a sliding door locking mechanism or a window locking mechanism which is capable of locking a wide variety of closures such as sliding windows, standard house windows, display case doors, sliding panel doors, sliding glass doors and the like.

A still further object of the present invention is to provide a sliding door locking mechanism or a window locking mechanism that can be mass produced in an automated and economical manner and is readily affordable by the consumer.

SUMMARY OF THE PRESENT INVENTION

In accordance with the present invention, there is provided a window or sliding glass door having a push button locking mechanism. The window or sliding door locking mechanism includes a cover having an internal compartment for receiving a push button locking assembly therein. The push button locking assembly includes a rocker lever arm sub-assembly, a locking pin, a releasing pin and a push button housing all connected together. The rocker lever arm sub-assembly includes a lever arm having a tensioning spring mounted on each outer end. The rocker lever arm sub-assembly is movable between a locking position and an unlocking position for activating the releasing pin to withdraw the locking pin from the push button housing in order to allow a pair of windows or sliding doors to be unlocked, and for activating the locking pin for insertion of the locking pin in the push button housing in order to lock a pair of windows or sliding doors in a locked position.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED AND ALTERNATE EMBODIMENTS

Preferred Embodiment 10

Figure 1:
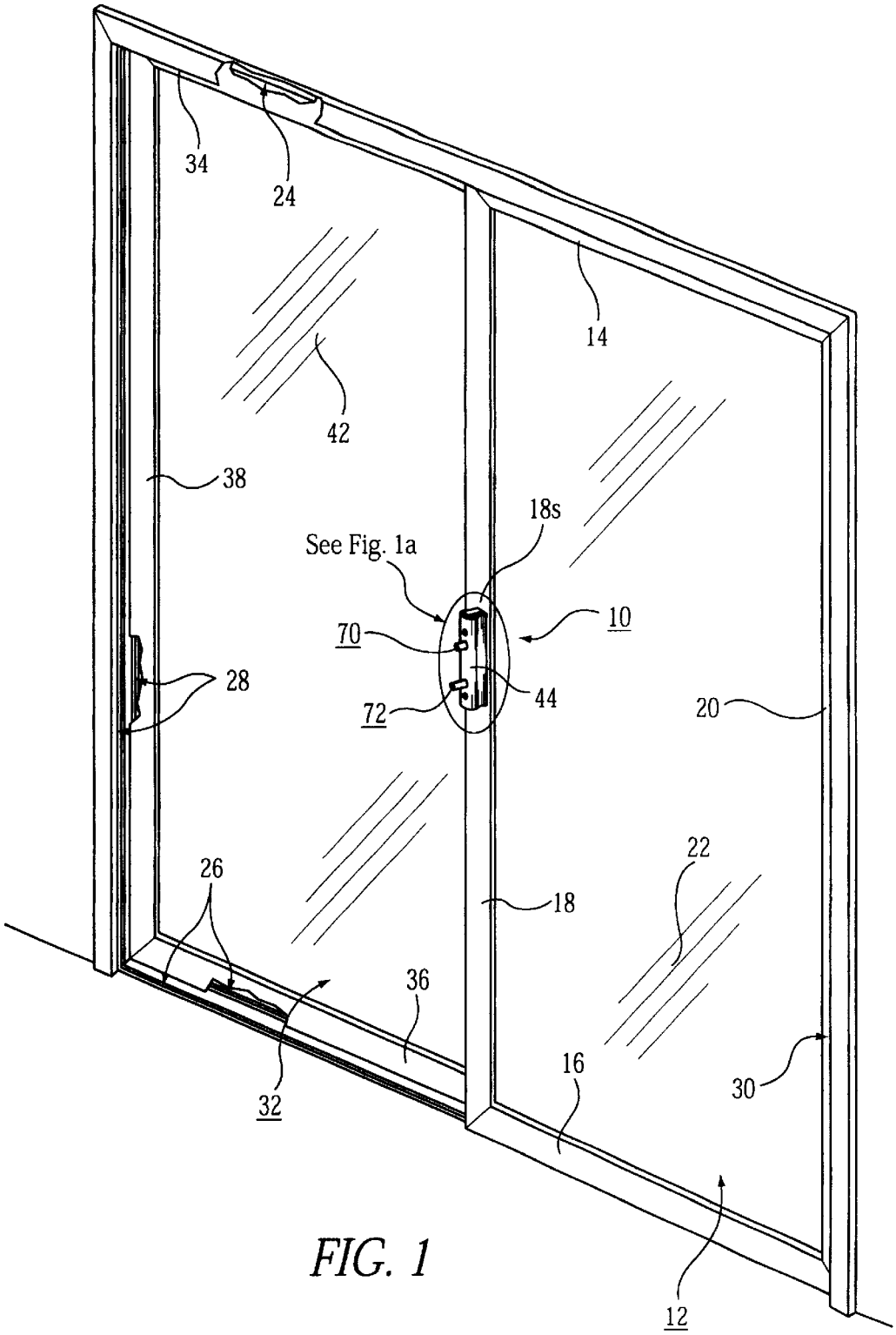
FIG. 1 is a front perspective view of a window or a sliding glass door locking mechanism of the preferred embodiment of the present invention showing the locking mechanism in an assembled configuration and in operational use where the sliding glass doors are in a closed position.
Figure 1A:
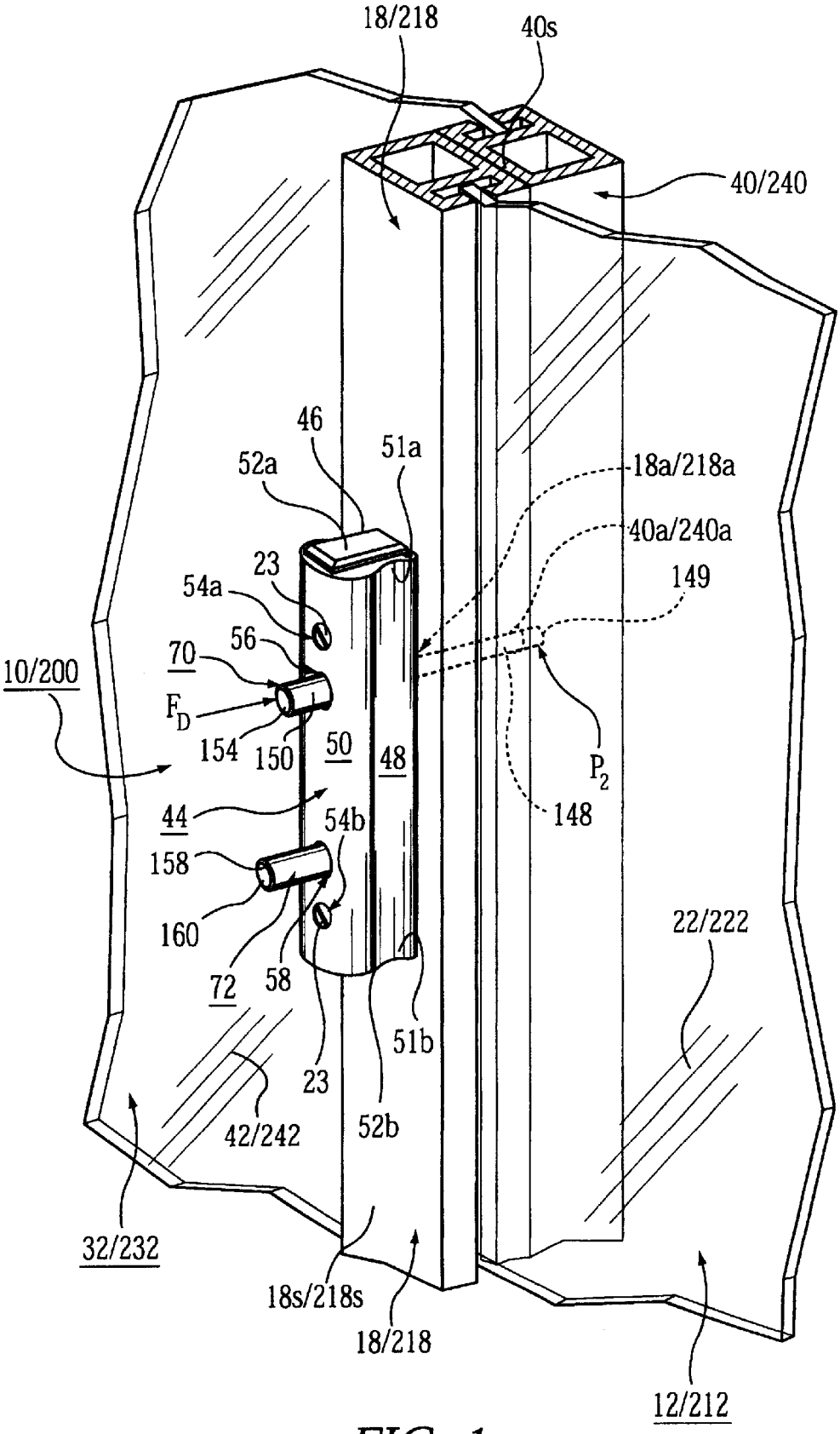
FIG. 1*a* is a perspective view of the sliding door locking mechanism of the present invention showing the locking mechanism in a closed position ($P_2$) on one of the sliding glass panels.
Figure 4:
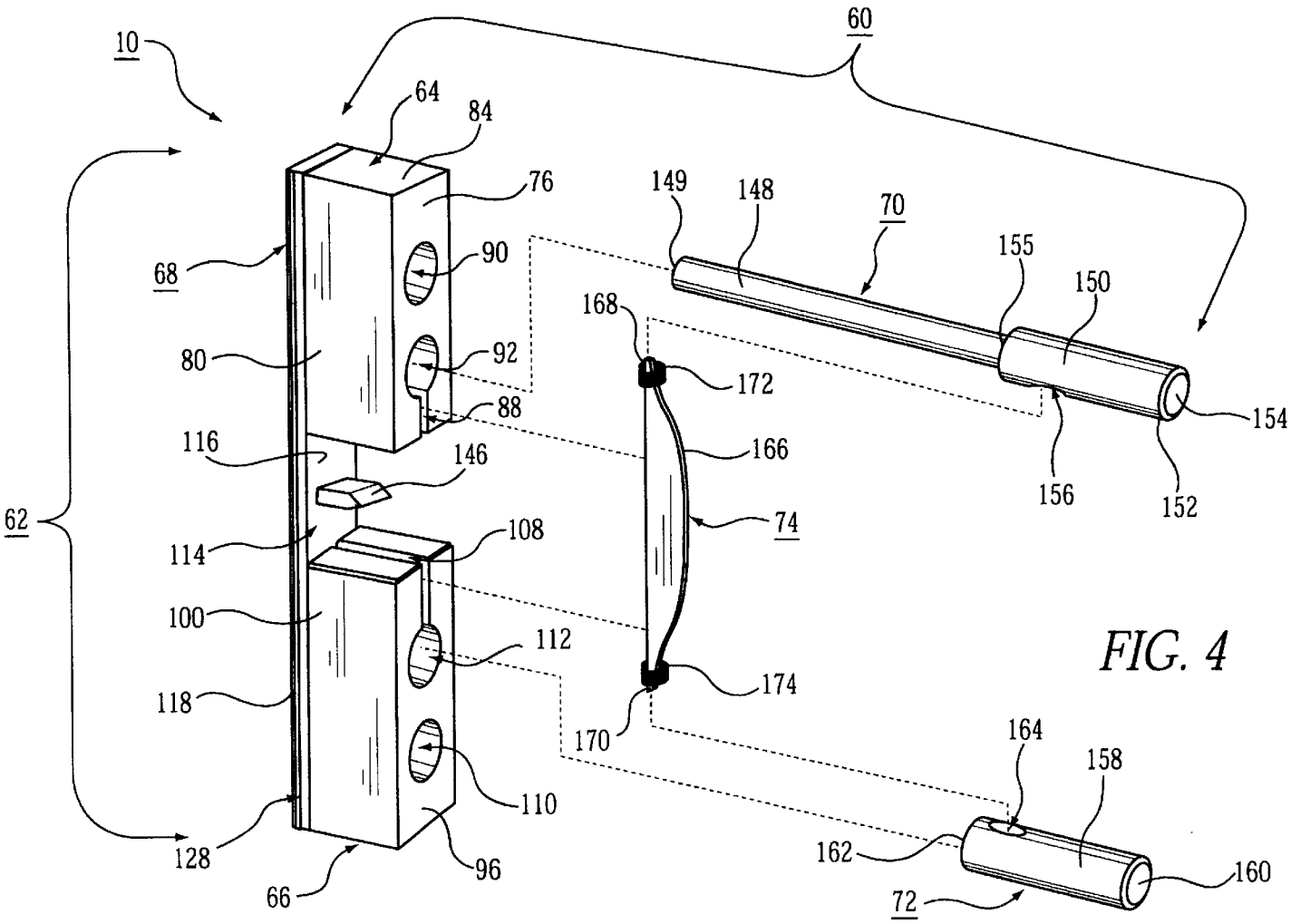
FIG. 4 is an exploded perspective view of the sliding door locking mechanism of the present invention showing a rocker lever arm sub-assembly being connected to a locking pin and a lock releasing pin and being attached to a push button housing for forming of the push button locking assembly.
Figure 5:
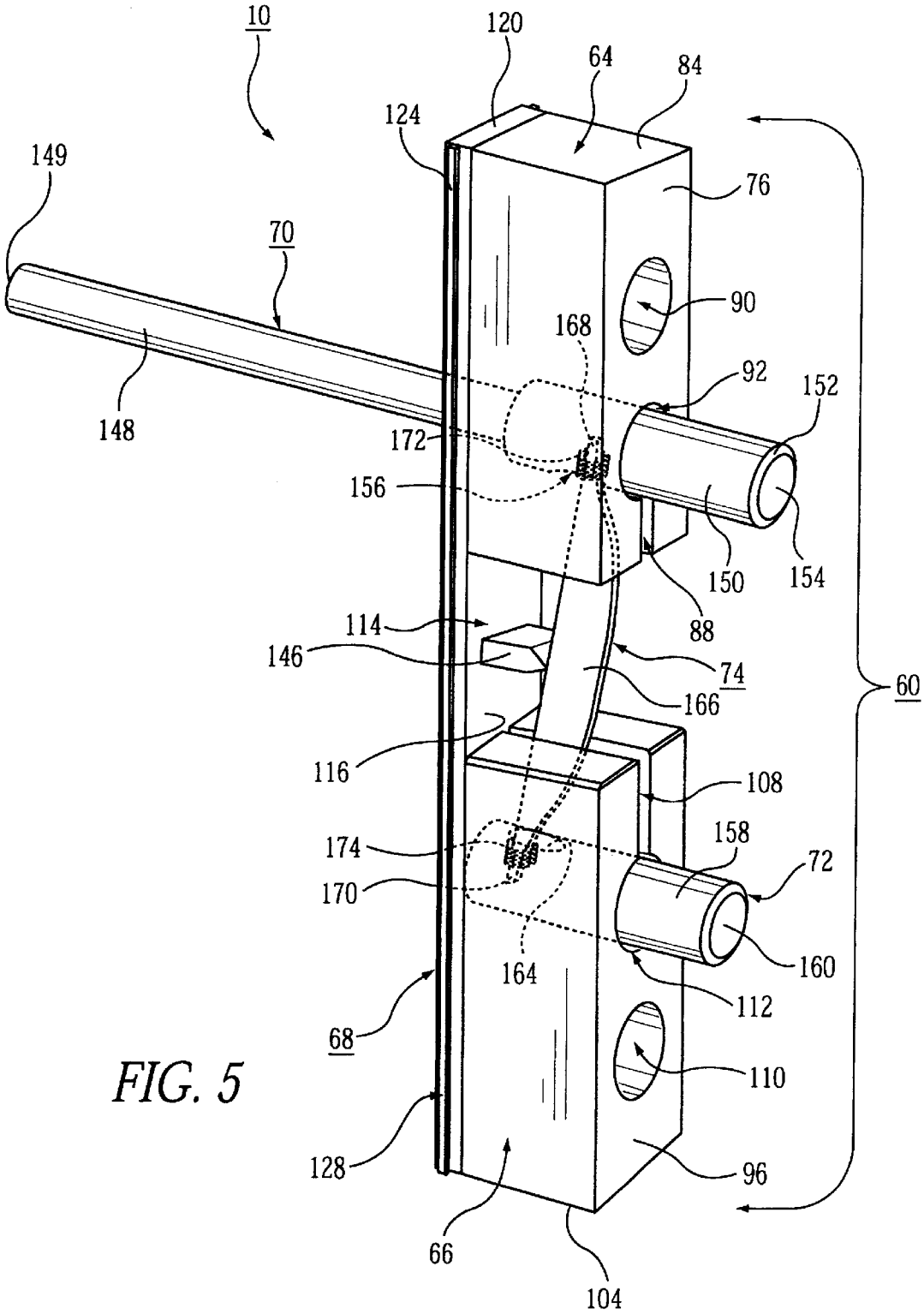
FIG. 5 is an enlarged perspective view of the sliding door locking mechanism of the present invention showing a push button locking assembly in a neutral position.
Figure 6:
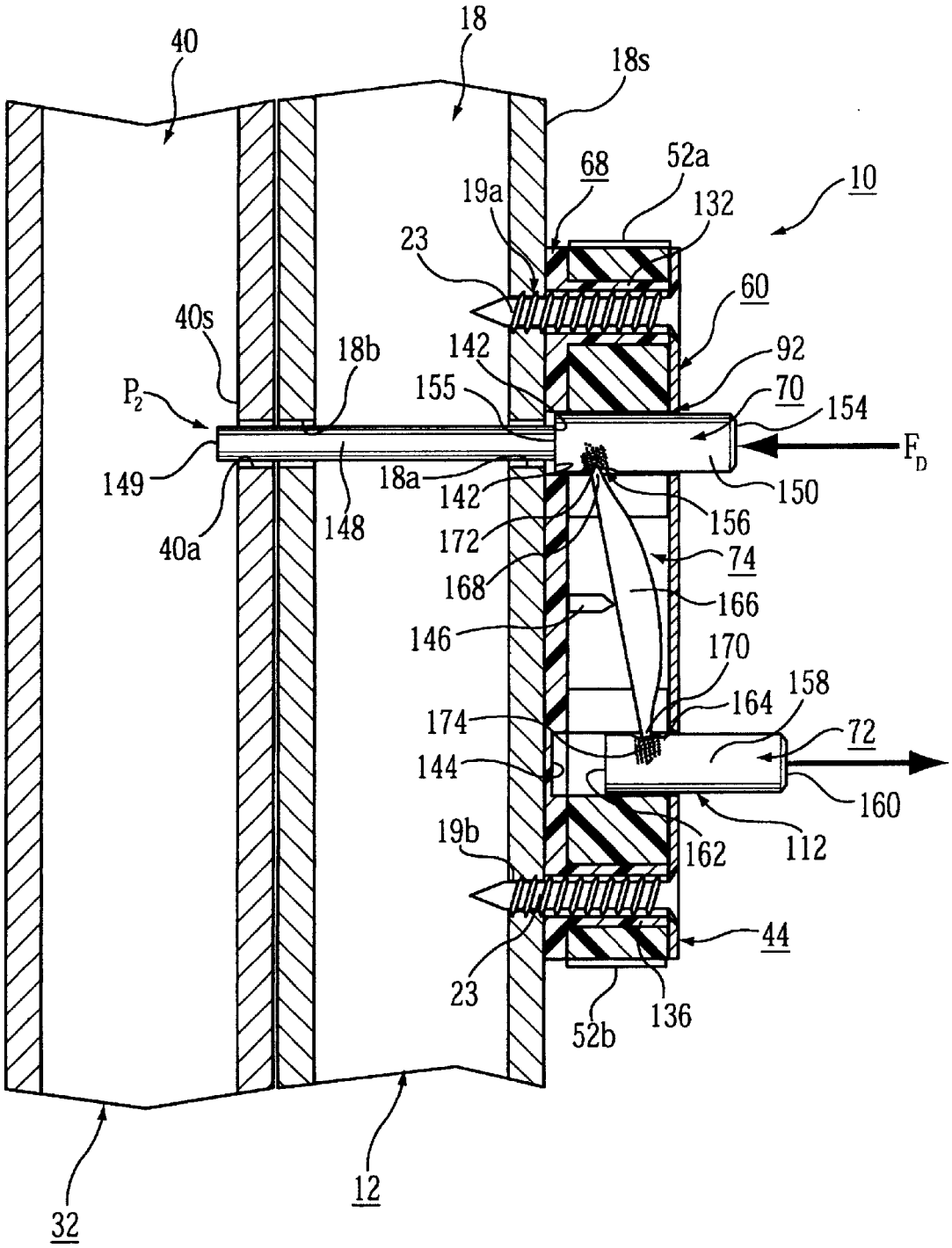
FIG. 6 is a cross-sectional view of the sliding door locking mechanism of the present invention showing the locking mechanism in a closed position.
Figure 7:
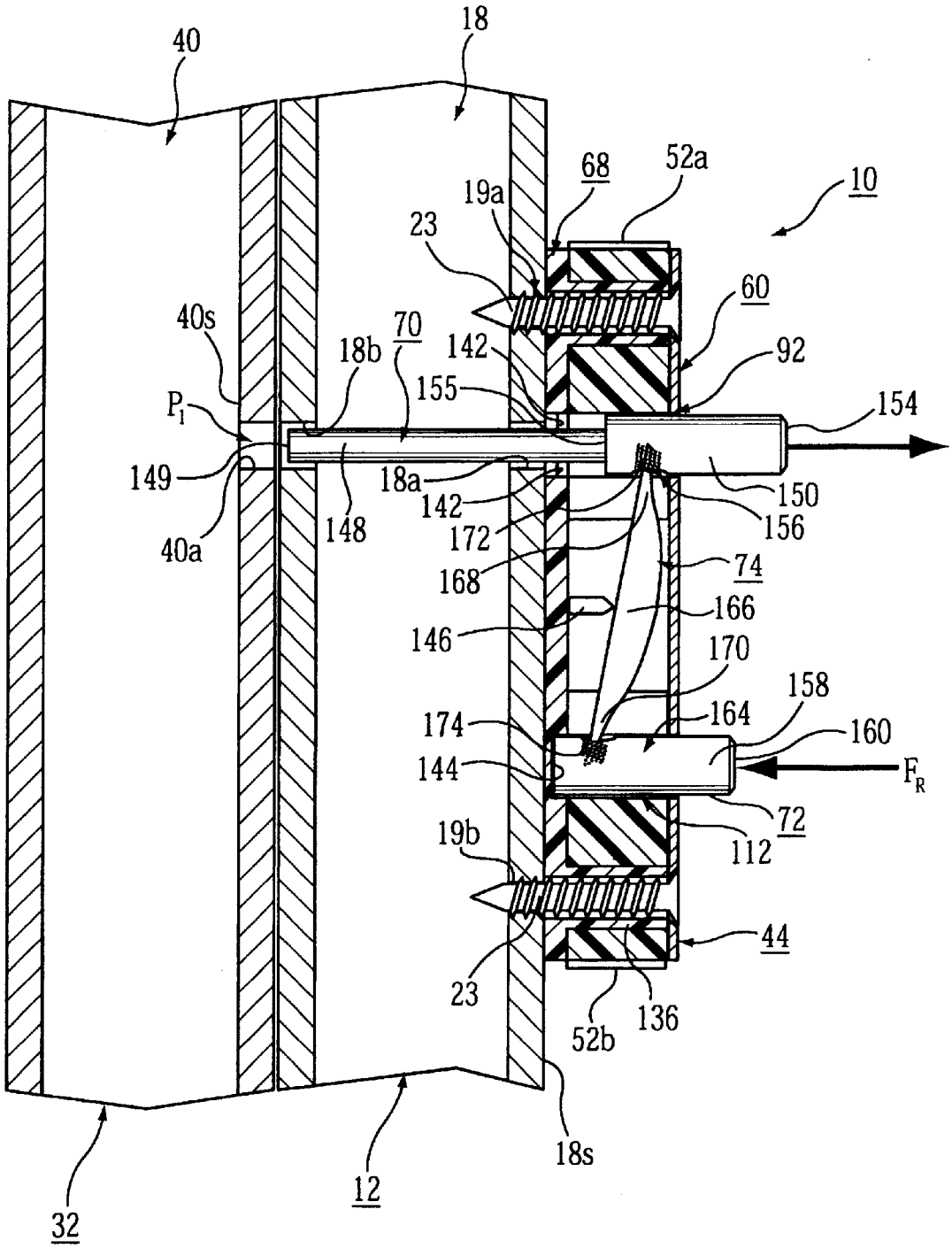
FIG. 7 is a cross-sectional view of the sliding door locking mechanism of the present invention showing the locking mechanism in an opened position.

A sliding door locking mechanism 10 having an integral push button locking assembly 60 is represented in detail by FIGS. 1 through 7 of the patent drawings. The sliding door locking mechanism 10 is used in conjunction with a pair of sliding glass doors/panels 12 and 32 being mounted between upper and lower sliding tracks 24 and 26; and opposing (vertical) side tracks 28 and 30. The first sliding glass panel 12, as shown in FIG. 1, includes an upper rail 14, a lower rail 16, and vertical stiles 18 and 20 for enclosing a glass window 22 therein. The second sliding glass panel 32, as shown in FIG. 1, includes an upper rail 34, a lower rail 36, and vertical stiles 38 and 40 for enclosing a glass window 42 therein. The sliding door locking mechanism 10 is centrally mounted on the inner vertical stile 18 of the first sliding glass panel 12, as shown in FIG. 1*a*. The outer wall surface 18*s* of inner vertical stile 18 includes mounting openings 19*a* and 19*b* for receiving mounting screws 23 in order to mount the locking mechanism 10 on the outer wall surface 18*s* of vertical stile 18. The outer wall surface 18*s* of inner vertical stile 18 also includes stile locking pin openings 18*a*, 18*b* for receiving an elongated shaft section 148 of a locking pin 70 therethrough. The outer vertical stile 40 includes a stile locking pin opening 40*a* for receiving an end tip 149 of the elongated shaft section 148 of locking pin 70 therethrough. Stile locking pin openings 18*a*, 18*b* and 40*a* are aligned with each other in order to receive the elongated shaft section 148 of locking pin 70 therethrough, as shown in FIGS. 6 and 7 of the drawings.

Figure 1B:
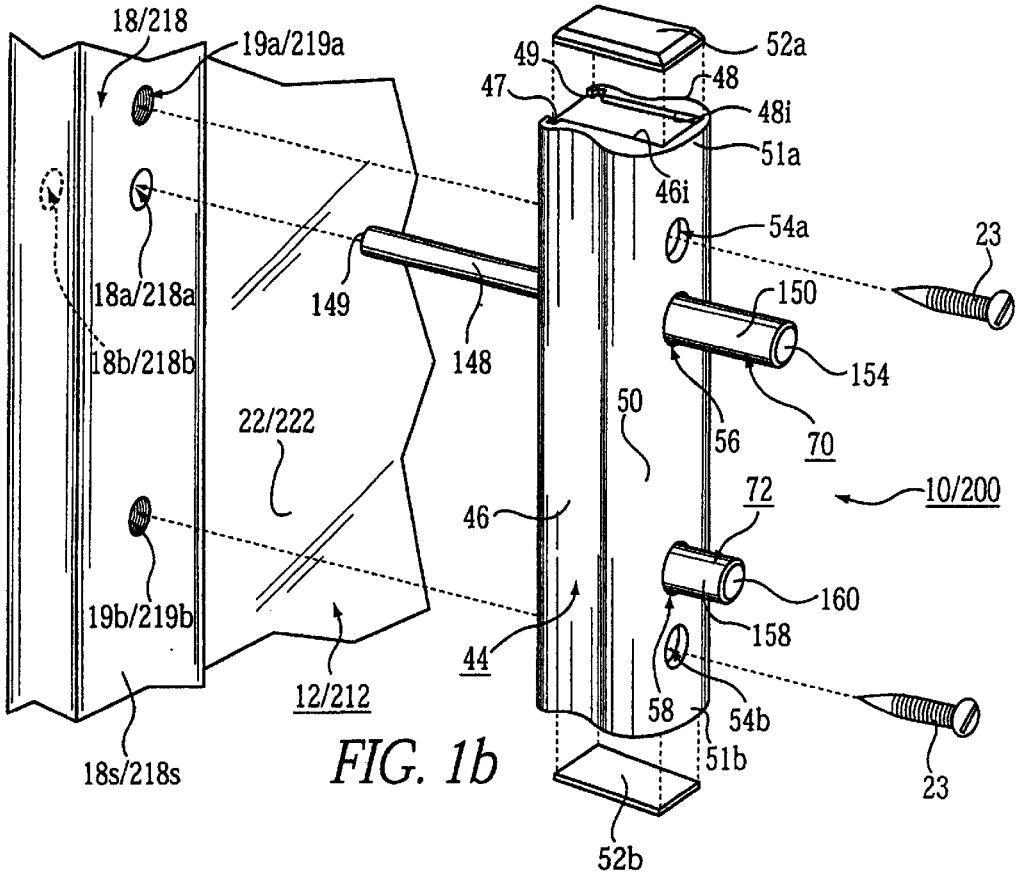
FIG. 1*b* is an exploded perspective view of the sliding door locking mechanism of the present invention showing the locking mechanism being attached to the inner vertical stile of one of the sliding glass panels.
Figure 2:
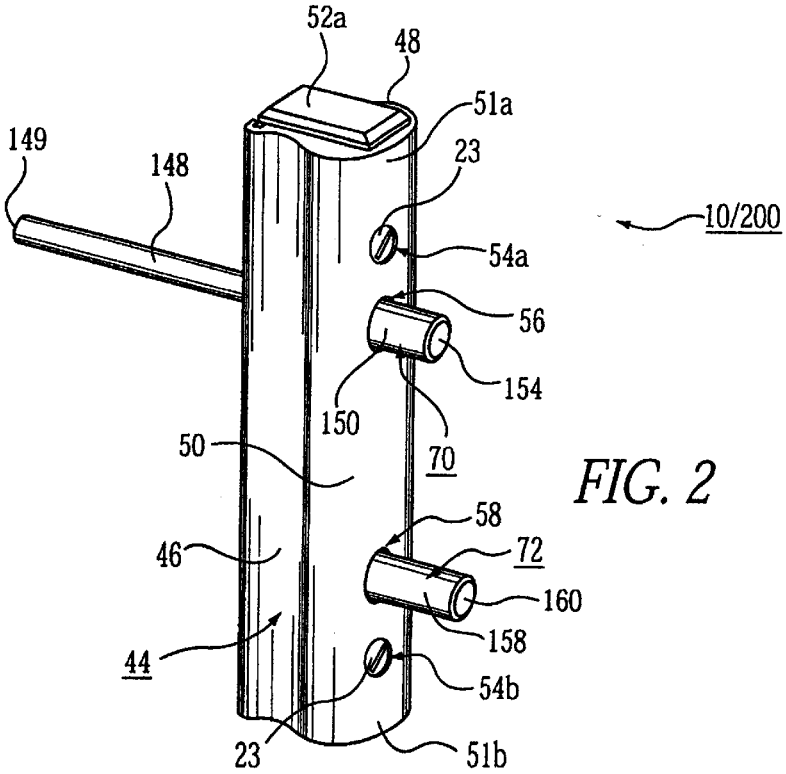
FIG. 2 is a front perspective view of the sliding door locking mechanism of the present invention shown in an assembled state.
Figure 3:
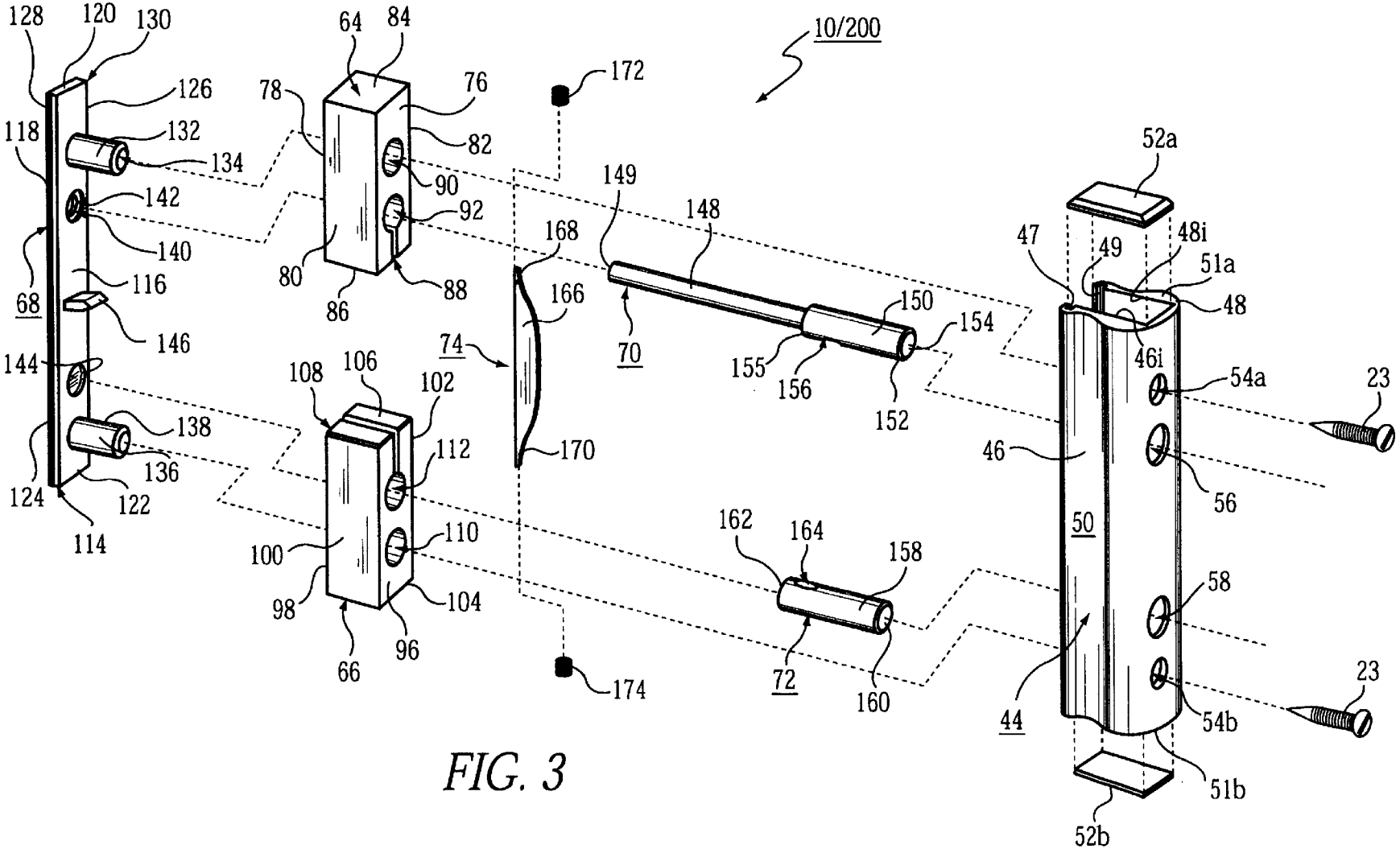
FIG. 3 is an exploded perspective view of the sliding door locking mechanism of the present invention showing the major component parts thereof.

The sliding locking mechanism 10 as show in FIGS. 2, 3 and 5 includes a locking cover 44 for housing the push button locking assembly 60 therein. The locking cover 44, as shown in FIG. 3, includes a pair of curved side walls 46 and 48 for gripping by a user's fingers being integrally connected to a top wall 50. Each of the curved side walls 46, 48 has an interior wall surface 46*i* and 48*i*, respectively. Each of the interior wall surfaces 46*i*, 48*i* of curved side walls 46, 48 includes an interior slide channel 47 and 49 for slidably receiving (snapping on) a pin block holding base plate 68 thereto (to be further discussed hereinafter). The top wall 50 includes a pair of opposing mounting openings 54*a* and 54*b* for receiving mounting screws 23 therein. Top wall 50 also includes a locking pin opening 56 for receiving a locking pin 70 therethrough and a release pin opening 58 for receiving a lock releasing pin/control pin 72 therethrough. The locking cover 44 further includes end sections 51*a* and 51*b*, and each end section 51*a* and 51*b* has an end cap 52*a* and 52*b*, respectively, thereon for enclosing the end sections 51*a*, 51*b* of the locking cover 44, as shown in FIGS. 1*a*, 1*b*, 2 and 3 of the drawings.

As shown in FIGS. 3 to 5, the push button locking assembly 60 includes a push button housing 62 having a pair of pin blocks 64, 66 connected to a pin block holding base plate 68. The push button locking assembly 60 further includes a locking pin 70 and a lock releasing pin/control pin 72. Additionally, the push button locking assembly 60 also includes a rocker lever arm sub-assembly 74 for moving the locking pin 70 to an opened position $P_1$ by depressing the lock releasing pin 72 inwardly, see FIGS. 6 and 7 of the drawings. Conversely, the rocker lever arm sub-assembly 74 is used for moving the lock releasing pin 72 outwardly by depressing the locking pin 70 inwardly in order to lock the sliding glass panels 12 and 32 in a closed position $P_2$, as depicted in FIGS. 1, 6 and 7 of the drawings.

Upper pin block 64 includes a top wall surface 76, a bottom wall surface 78, side wall surfaces 80 and 82, an outer end wall surface 84 and an inner end wall surface 86 having a center grooved channel 88 therein. Grooved channel 88 extends from the top wall surface 76 to the bottom wall surface 78, as depicted in FIGS. 3 to 5. The pin block 64 further includes an outer shaft opening 90 and an inner locking pin opening 92. Both shaft opening 90 and locking pin opening 92 extend from the top wall surface 76 to the bottom wall surface 78. Pin block 64 is substantially rectangularly-shaped and is made from a durable plastic material.

Lower pin block 66 includes a top wall surface 96, a bottom wall surface 98, side wall surface 100 and 102, an outer end wall surface 104 and an inner end wall surface 106 having a centered grooved channel 108 therein. Grooved channel 108 extends from the top wall surface 96 to the bottom wall surface 98, as depicted in FIGS. 3 to 5. The pin block 66 further includes an outer shaft opening 110 and an inner release pin opening 112. Both shaft opening 110 and release pin opening 112 extend from the top wall surface 96 to the bottom wall surface 98. Pin block 66 is also substantially rectangularly-shaped and is made from a durable plastic material.

Base plate 68 includes, as shown in FIGS. 3, 4 and 5 of the drawing, a base member 114 having a top wall surface 116, a bottom wall surface 118, an upper end wall surface 120, a lower end wall surface 122, and side wall surfaces 124 and 126. Each of the side wall surfaces 124, 126 includes an outer retaining edge tab 128 and 130. Each of the retaining edge tabs 128, 130 of base member 114 are received within each of the interior slide channels 47, 49 of cover 44, respectively, as shown in FIG. 3. The base member 114 further includes an upper shaft member 132 having an upper shaft member opening 134 and a lower shaft member 136 having a lower shaft member opening 138. The upper shaft member 134 is adjacent to the upper end wall surface 120 and the lower shaft member 136 is adjacent to the lower end wall surface 122. The base member 114 also includes an upper base locking pin opening 140 having a circumferential interior perimeter edge 142 and a circular lower releasing pin interior compartment 144. The upper base locking pin opening 140 is spaced-apart and adjacent to the upper shaft member 134 and the lower releasing pin circular compartment 144 is spaced-apart and adjacent to the lower shaft member 136, as show in FIG. 3 of the drawings. Additionally, the base member 114 includes a centrally positioned fulcrum element 146 for use with the rocker lever arm sub-assembly 74. Fulcrum element 146 is integrally connected to the top wall surface 116 of base member 114. Base member 114 is a substantially elongated rectangularly-shaped structure being made from a blow molded durable plastic material.

As shown in FIGS. 1, 3 to 5, the locking pin 70 includes an elongated cylindrical shaft section 148 having an end tip 149 and being attached to a larger diameter push button section 150 having a proximal chamfered circumferential perimeter edge 152, an outer end wall surface 154 for finger contact by the user and a distal circumferential perimeter edge 155. The push button section 150 includes a recessed hole opening 156*f* or receiving one end section 168 of lever arm 166 of rocker lever arm sub-assembly 74 therein.

The lock releasing pin 72, as shown in FIGS. 1, 3 to 5, includes a large diameter cylindrical push button section 158 having an outer end wall surface 160 for finger contact by the user and an inner lower end wall surface 162 for contacting the top wall surface 116 of base member 114. The button pushing section 158 includes a recessed hole opening 164 for receiving the other end section 170 of lever arm 166 of rocker lever arm sub-assembly 74.

The rocker lever arm sub-assembly 74, as shown in FIGS. 3 to 5, include a lever arm 166 having outer tapered end sections 168 and 170. Each of the outer end sections 168, 170 includes an attachable tensioning spring 172 and 174 thereon for keeping each of the outer end sections 168, 170 of lever arm 166 tensioned within each of the recessed hole openings, 156, 164 of pins 70, 72, respectively, as shown in FIGS. 4 to 6 of the drawings. Tensioning spring 172 is within recessed hole opening 156 and tensioning spring 174 is within recessed hold opening 164, as shown in FIG. 5. Lever arm 166 has a semi-arc shaped configuration (see FIG. 4) being made from a thin metal sheet material such as steel, stainless steel or aluminum.

In assembling the rocker lever arm sub-assembly 74 to the push button housing 62 of push button locking assembly 60, the manufacturer places and aligns the outer shaft opening 90 of the upper pin block 64 with that of the outer and upper shaft member 132 of the base member 114 and pushes the pin block 64 downwardly such that the bottom wall surface 78 of pin block 64 is in contact and abutting the top wall surface 116 of base member 114, where then the inner locking pin opening 92 of pin block 64 is also aligned with the upper base locking pin opening 140 of base member 114. This alignment has the side wall surfaces 80, 82 of pin block 64 flush and aligned with the side wall surfaces 124, 126 of base member 114, respectively, see FIGS. 4 and 5 of the drawings.

The manufacturer in a similar manner again places and aligns the outer shaft opening 110 of the lower pin block 66 with that of the outer and lower shaft member 136 of base member 114 and pushes the pin block 66 downwardly such that the bottom wall surface 98 of pin block 66 is in contact and abutting the top wall surface 116 of base member 114, where then the inner release pin opening 112 of pin block 66 is also aligned with the lower base release pin compartment 144 of base member 114. This alignment has the side wall surfaces 100, 102 of pin block 66 flush and aligned with the side wall surfaces 124, 126 of base member 114, respectively, as depicted in FIGS. 4 and 5 of the drawings.

The manufacturer now aligns and places each of the outer end sections 168, 170 having tensioning springs 172, 174, respectively, thereon within each of the upper and lower grooved channels 88, 108 of pin blocks 64, 66, respectively. Each of the outer end sections 168, 170 are further aligned and inserted within each of recessed hole openings 156, 164 of pins 70, 72, respectively, as depicted in FIGS. 4 and 5 of the drawings. This now completes the formation and assembly of the push button locking assembly 60.

In the final assembling step for the formation of the assembled sliding door locking mechanism 10, as shown in FIGS. 2 to 4, the manufacturer now slidably snaps-on and encloses the cover 44 onto the push button locking assembly 60 such that each of the push button sections 150, 158 of pins 70, 72 are received within each of the corresponding pin openings 56, 58 on the top wall 50 of cover 44, respectively, therethrough. Also, the interior slide channels 47, 49 of cover 44 are received (snapped-on) by each of the outer retaining tab edges 128, 130 of base plate 68 of push button housing 62, respectively. The mounting opening 54*a*, 54*b* of cover 44 are now aligned with the corresponding shaft member openings 134, 138 of base member 114, respectively, for receiving mounting screws 23 therethrough in order to mount the sliding door locking mechanism 10 on the mounting openings 19*a*, 19*b*, on the outer wall surface 18*s* of inner vertical stile 18 of the first glass panel 12, respectively, as shown in FIGS. 1*a* of the drawings.

Alternate Embodiment 200

Figure 8:
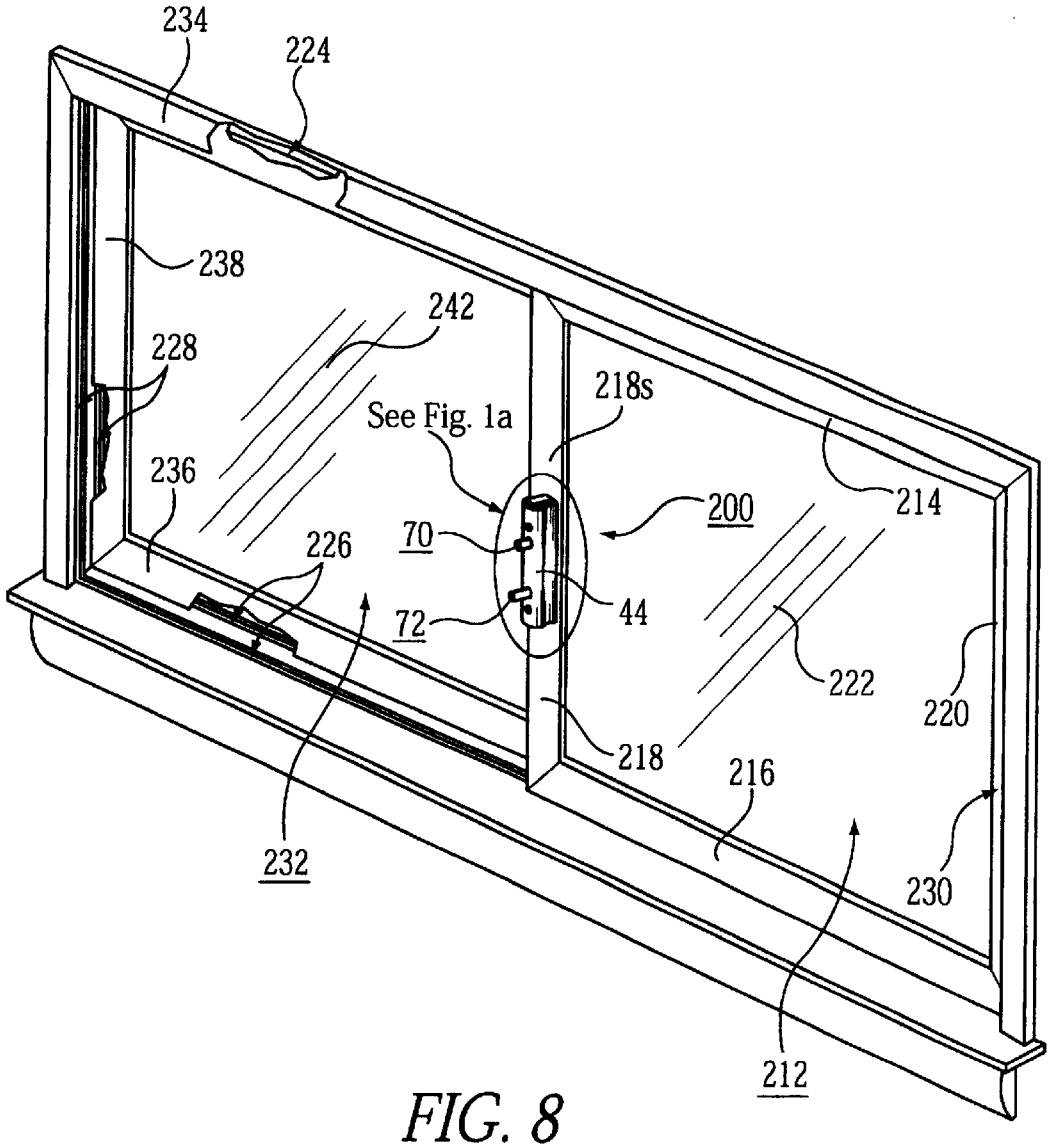
FIG. 8 is a front perspective view of a window locking mechanism of an alternate embodiment of the present invention showing the window locking mechanism in an assembled configuration and in operational use where the sliding glass windows are laterally moved to a closed position.
Figure 9:
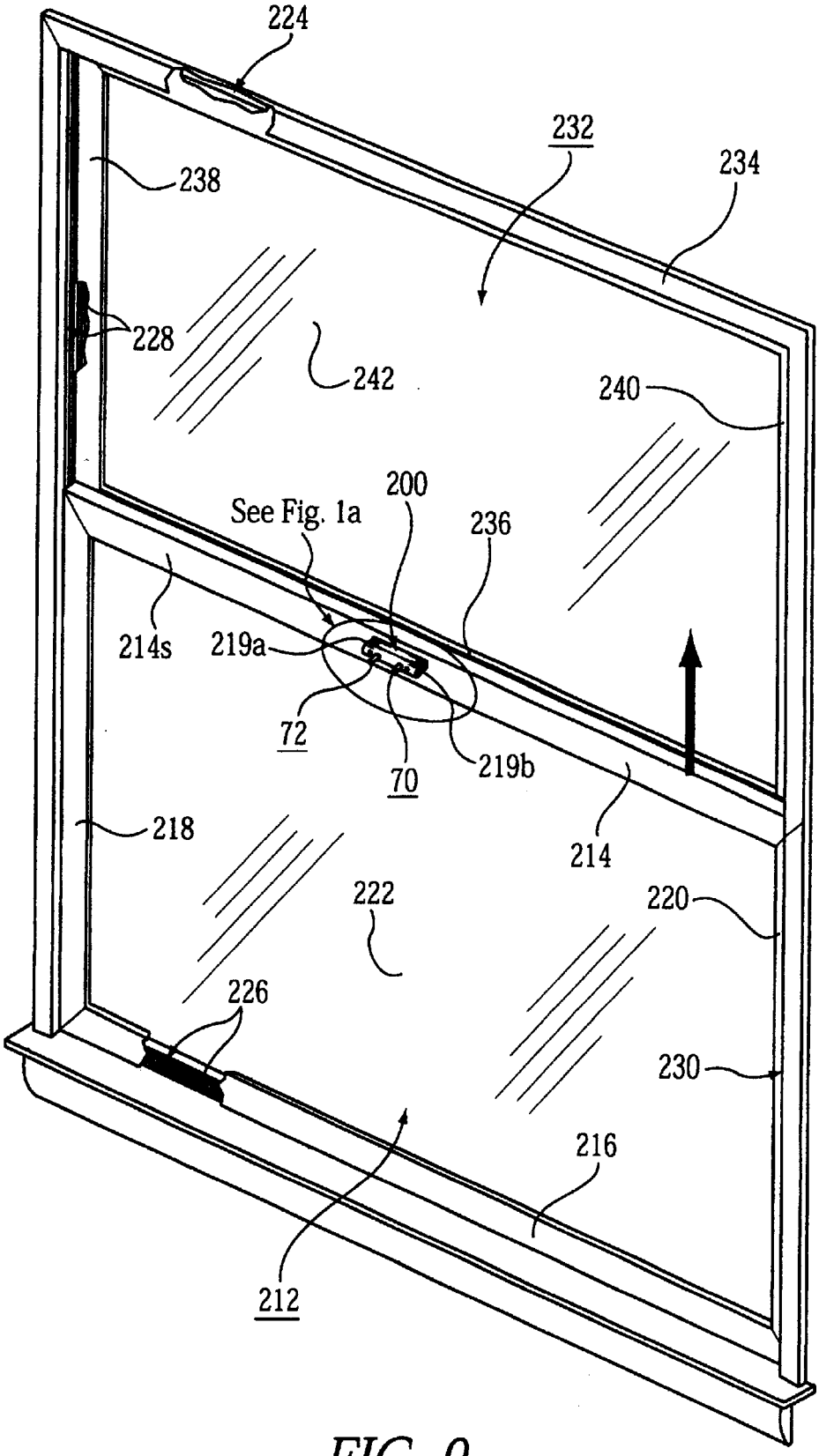
FIG. 9 is a front perspective view of the window locking mechanism of the alternate embodiment of the present invention showing the window locking mechanism in an assembled configuration and in operational use where the glass windows are moved vertically to a closed position.

In an alternate embodiment, a window locking mechanism 200 has an integral push button locking assembly 60 which is represented in detail by FIGS. 1*a*, 1*b*, 2, 3, 8 and 9 of the patent drawings. As shown in FIG. 8, the window locking mechanism 200 is used in conjunction with a pair of sliding glass windows 212 and 232 being mounted between upper and lower sliding tracks 224 and 226; and opposing (vertical) side tracks 228 and 230. Alternatively, the windows may move vertically, as shown in FIG. 9, using the window locking mechanism 200. The first sliding glass window panel 212, as shown in FIG. 8, includes an upper rail 214, a lower rail 216, and vertical stiles 218 and 220 for enclosing a glass window 222 therein. The second sliding glass window panel 232, as shown in FIG. 8, includes an upper rail 234, a lower rail 236, and vertical stiles 238 and 240 for enclosing a glass window 242 therein. The sliding window locking mechanism 200 is centrally mounted on the inner vertical stile 218 of the first sliding glass panel 212, as shown in FIG. 1*a*. The outer wall surface 218*s* of inner vertical stile 218 includes mounting openings 219*a* and 219*b* for receiving mounting screws 23 in order to mount the locking window mechanism 200 on the outer wall surface 218*s* of vertical stile 218. The outer wall surface 218*s* of inner vertical stile 118 also includes stile locking pin openings 218*a*, 218*b* for receiving an elongated shaft section 248 of a locking pin 70 therethrough. The outer vertical stile 240 includes a stile locking pin opening 240*a* for receiving an end tip 149 of the elongated shaft section 148 of locking pin 70 therethrough. Stile locking pin openings 218*a*, 218*b* and 240*a* are aligned with each other in order to receive the elongated shaft section 148 of locking pin 70 therethrough, as shown in FIGS. 1*a* and 1*b* of the drawings. All of the component parts of the window locking mechanism 200 of the alternate embodiments are exactly the same as the sliding door locking mechanism 10 of the preferred embodiment, as shown in FIG. 3 of the patent drawings. The window locking mechanism 200 may be used with windows that slide laterally (see FIG. 8) or move up and down (see FIG. 9).

As depicted in FIG. 9 of the drawings, the window locking mechanism 200 is used in conjunction with a pair of vertically mounted glass windows 212 and 232 being mounted between upper and lower sliding tracks 224 and 226; and opposing (vertical) side tracks 228 and 230. The first (vertically mounted) lower glass window 212, as shown in FIG. 9, includes an upper rail 214, a lower rail 216, and vertical stiles 218 and 220 for enclosing a glass window 222 therein. The second (vertically mounted) upper glass window 232, as shown in FIG. 9, includes an upper rail 234, a lower rail 236, and vertical stiles 238 and 240 for enclosing a glass window 242 therein. The window locking mechanism 200 is centrally mounted to the upper rail 214 of the first glass window 212. The outer wall surface 214*s* of the upper rail 214 includes mounting openings 219*a* and 219*b* for receiving mounting screws 23 in order to mount the locking window mechanism 200 to the outer wall surface 214*s* of upper rail 214. The window locking mechanism 200 may be substantially smaller in size (see FIG. 9) than the preferred embodiment of the sliding window locking mechanism 10 (see FIG. 1). Further, the interconnections of the window locking mechanism 200 are exactly the same as shown in FIG. 1*a*, 1*b* except the mounting openings and pin openings are through the upper rail 214 and lower rail 236 of the vertically mounted glass windows 212 and 232, respectively.

OPERATION OF THE PRESENT INVENTION

In operation, the sliding door locking mechanism 10 operates in the following manner, as shown in FIGS. 1, 6, and 7 of the drawings. In order to close and lock the sliding door locking mechanism 10 within the sliding glass panels 12 and 32, the user simply aligns vertical stiles 18, 40 of glass panels 12, 32 with each other, such that the stile locking pin openings 18*a*, 40*a* are aligned with each other in order to receive the elongated shaft section 148 of locking pin 70 therethrough, as shown in FIG. 1. As shown in FIG. 6, the user now simply depresses inwardly ($F_D$) on the outer end wall surface 154 of push button section 150 of locking pin 70 with his or her fingers, such that the elongated shaft section 148 of locking pin 70 slides through each of the stile locking pin openings 18*a*, 18*b* and 40*a* of stiles 18, 40, respectively. This inward movement ($F_D$) is accomplished via the rocker lever arm sub-assembly 74 where the outer end section 170 of lever arm 166 moves in an outwardly direction, such that the lock releasing pin 72 also slidably moves in an outwardly direction within the inner release pin opening 112 of pin block 66 of the push button locking assembly 60. The locking pin 70 movement is stopped as the distal perimeter edge 155 of the push button section 150 of locking pin 70 comes in contact with the circumferential interior perimeter edge 142 within the upper base locking pin opening 140 of base plate 68. This inward movement of locking pin 70 then moves the end tip 149 of the elongated shaft section 148 of locking pin 70 to protrude from an inner wall surface 40*s* of stile 40. This locking action prevents the sliding glass panels 12, 32 from moving in a horizontal direction relative to each other, and the sliding door locking mechanism 10 and sliding glass panels 12, 32 are in a locked and closed position $P_2$, as depicted in FIGS. 1*a* and 6 of the drawings.

To unlock the sliding door locking mechanism 10 relative to each of the sliding glass panels 12, 32, as shown in FIG. 7, the user simply depresses inwardly ($F_R$) the upper end wall surface 160 of push button section 158 of locking release pin 72 with his or her finger, such that the lower end wall surface 162 of the push button section 158 of locking release pin 72 comes in contact within the lower release pin compartment 144 of base member 114. This inward movement ($F_R$) is accomplished via the rocker lever arm sub-assembly 74 where the outer end section 168 of lever arm 166 moves in an outward direction, such that the locking pin 70 slidably moves in an outwardly direction within the locking pin openings 140, 92 of push button locking assembly 60. This outward movement by locking pin 70 then moves the end tip 149 of the elongated shaft section 148 of locking pin 70 from each of the stile locking pin openings 40*a*, 18*a* and 18*b* of stiles 40, 18 in order for the user to open the sliding glass panels 12, 32 and sliding door locking mechanism 10 to an opened position $P_1$, as shown in FIG. 7 of the drawings.

The operation of the alternate embodiments (see FIGS. 8 and 9) of the window locking mechanism 200 operates in the same exact manner as the sliding door locking mechanism 10 of the preferred embodiment.

ADVANTAGES OF THE PRESENT INVENTION

Accordingly, an advantage of the present invention is that it provides for a window locking mechanism or a sliding door locking mechanism having an integrated push button locking mechanism that requires only a minimal number of internal moving component parts.

Another advantage of the present invention is that it provides for an integrated push button locking mechanism that includes a control knob or a lock releasing pin, a locking pin and a rocker lever arm, wherein the rocker lever arm is used for inserting or retracting the locking pin from one of the glass sliding door stiles in order to allow the two glass sliding doors to be opened or closed accordingly.

Another advantage of the present invention is that it provides for a window locking mechanism or a sliding door locking mechanism that is capable of withstanding everyday wear and tear.

Another advantage of the present invention is that it provides for a window locking mechanism or a sliding door locking mechanism having an integrated push button locking mechanism that is secure, safe, efficient, durable and easy to use.

Another advantage of the present invention is that it provides for a window locking mechanism or a sliding door locking mechanism that is easily installed without the necessity for extensive modifications of the existing windows or sliding glass doors.

Another advantage of the present invention is that it provides for a sliding door locking mechanism that prevents the panels of the glass siding doors from sliding horizontally relative to each other in their respective tracks.

Another advantage of the present invention is that it provides for a sliding door locking mechanism that is aesthetically pleasing and unobtrusive when mounted on the vertical stile of one of the sliding glass doors.

Another advantage of the present invention is that it provides for a window locking mechanism or a sliding door locking mechanism that is rapidly locked and unlocked to a closed or opened position.

Another advantage of the present invention is that it provides for a sliding door locking mechanism that is permanently mounted on the vertical stile using a minimum number of tools.

A further advantage of the present invention is that it provides for a window locking mechanism or a sliding door locking mechanism which is capable for locking a wide variety of closures such as sliding windows, standard house windows, display case doors, sliding panel doors, sliding glass doors and the like.

A still further advantage of the present invention is that it provides for a window locking mechanism or a sliding door locking mechanism that can be mass produced in an automated and economical manner and is readily affordable by the consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A window locking mechanism or sliding door locking mechanism having a push button locking mechanism, comprising;

a) a cover having an internal compartment for receiving a push button locking assembly therein;

b) said push button locking assembly including a rocker lever arm sub-assembly, a locking pin, a releasing pin and a push button housing; said rocker lever arm sub-assembly being connected to said locking pin and said releasing pin, and said rocker lever arm sub-assembly also being attached to said push button housing all for forming said push button locking assembly;

c) said rocker lever arm sub-assembly including a lever arm having opposing outer end sections, each of said opposing outer end sections having a tensioning spring mounted thereon;

d) said locking pin including an elongated cylindrical shaft section having a distal end tip, a proximal end section and a first push button section, said proximal end section being connected to said first push button section, said push button section including a recessed hole opening for receiving the first end of said outer end sections of said lever arm;

e) said releasing pin including a second push button section having an inner distal end and outer proximal end, said second push button section including a recessed hole opening for receiving the second end of said outer end sections of said lever arm;

f) said push button housing includes a pair of holding means and a base plate being connected to each other, and each of said holding means for slidably holding said locking pin and said releasing pin, respectively, therein; and g) said rocker lever arm sub-assembly being movable between a locking position and an unlocking position for activating said releasing pin to withdraw said locking pin from said push button housing in order to allow a pair of windows or doors to be unlocked, and for activating said locking pin for insertion of said locking pin in said push button housing in order to lock the pair of doors or windows in a locked position.

2. A sliding door locking mechanism in accordance with claim 1, wherein said cover includes a top wall, side walls, opposing end sections and an interior wall surface.

3. A sliding door locking mechanism in accordance with claim 2, wherein said top wall including a pair of opposing mounting openings, a locking pin opening for receiving said locking pin therethrough and a releasing pin opening for receiving said releasing pin therethrough.

4. A sliding door locking mechanism in accordance with claim 2, wherein each of said side walls include a slide channel on said interior wall surface for slidably connecting said push button housing thereto.

5. A sliding door locking mechanism sin accordance with claim 2, wherein each of said end sections includes an end cap thereon, each of said end caps for enclosing said end sections on said cover.

6. A sliding locking mechanism in accordance with claim 1, wherein each of said holding means having means for connecting said rocker lever arm sub-assembly to each of said locking pin and said releasing pin, respectively, thereto.

7. A sliding door locking mechanism in accordance with claim 1, wherein said base plate includes a base member having a top wall surface, a bottom wall surface, upper and lower end wall surfaces and side wall surfaces.

8. A sliding door locking mechanism in accordance with claim 7, wherein each of said side wall surfaces includes an outer retaining tab, wherein each of said outer retaining tabs of said base member are received within each of said interior slide channels of said cover holding said push button housing in place.

9. A sliding door locking mechanism in accordance with claim 7, wherein said base member includes an upper shaft member having an upper shaft member opening therein, said upper shaft member being proximate and adjacent to said upper end wall surface.

10. A sliding door locking mechanism in accordance with claim 7, wherein said base member includes a lower shaft member having a lower shaft member opening therein, said lower shaft member being proximate and adjacent to said lower end wall surface.

11. A sliding door locking mechanism in accordance with claim 7, wherein said base member further includes an upper base locking pin opening having a circumferential perimeter edge thereon, said upper base locking pin opening being spaced-apart and adjacent to said upper shaft member, and said base locking pin opening is for receiving said elongated cylindrical shaft section therethrough.

12. A sliding door locking mechanism in accordance with claim 7, wherein said base member further includes a lower releasing pin circular compartment, said lower releasing pin circular compartment, said lower releasing pin circular compartment being spaced-apart and adjacent to said lower shaft member, and said lower releasing pin circular compartment is for receiving said inner distal end of said second push button section of said releasing pin.

13. A sliding door locking mechanism in accordance with claim 7, wherein said base member also includes a centrally positioned fulcrum elements, said fulcrum element being connected to the top wall surface of said base member, and said fulcrum element for use with said rocker lever arm sub-assembly allowing said lever arm to pivot and rock about said lever arm.

14. A sliding door locking mechanism in accordance with claim 7, wherein said base member is a substantially elongated rectangularly shaped structure being made from a plastic material.

15. A sliding door locking mechanism in accordance with claim 5, wherein one of said holding means includes an upper pin block having a top wall surface, a bottom wall surface, side wall surfaces, and outer end wall surface and an inner end wall surface having a first center grooved channel therein.

16. A sliding door locking mechanism in accordance with claim 15, wherein said first grooved channel extends from said top wall surface to said bottom wall surface of said upper pin block.

17. A sliding door locking mechanism in accordance with claim 15, wherein said upper pin block further includes an outer shaft opening and an inner locking pin opening.

18. A sliding door locking mechanism in accordance with claim 17, wherein said outer shaft opening and said inner locking pin opening extend from said top wall surface to said bottom wall surface of said upper pin block.

19. A sliding door locking mechanism in accordance with claim 17, wherein said outer shaft opening of said upper pin block aligns and receives said upper shaft member of said base member such that said bottom wall surfaces of said upper pin block is in contact and abutting said top wall surface of said base member.

20. A sliding door locking mechanism in accordance with claim 19, wherein said inner locking pin opening of said upper pin block is also aligned with said upper base locking pin opening of said base member such that this alignment has said side wall surfaces of said upper pin block flush and aligned with said side wall surfaces of said base member, respectively.

21. A sliding door locking mechanism in accordance with claim 20, wherein said aligned inner locking pin opening and said upper base locking pin opening are for slidably receiving said first push button section of said locking pin therethrough.

22. A sliding door locking mechanism in accordance with claim 6, wherein the other of said holding means includes a lower pin block having a top wall surface, a bottom wall surface, side wall surfaces, an outer end wall surface and an inner end wall surface having a second center grooved channel therein.

23. A sliding door locking mechanism in accordance with claim 22, wherein said second grooved channel extends from said top wall surface to said bottom wall surface of said lower pin block.

24. A sliding door locking mechanism in accordance with claim 22, wherein said lower pin block further includes an outer shaft opening and an inner releasing pin opening.

25. A sliding door locking mechanism in accordance with claim 24, wherein said outer shaft opening and said inner releasing pin opening extend from said top wall surface to said bottom wall surface of said lower pin block.

26. A sliding door locking mechanism in accordance with claim 24, wherein said outer shaft opening of said lower pin block aligns and receives said lower shaft member of said base member such that said bottom wall surface of said lower pin block is in contact and abutting said top wall surface of said base member.

27. A sliding door locking mechanism in accordance with claim 26, wherein said inner releasing pin opening of said lower pin block is also aligned with said lower releasing pin compartment of said base member such that this alignment has said side wall surfaces of said lower pin block flush and aligned with said side wall surfaces of said base member, respectively.

28. A sliding door locking mechanism in accordance with claim 27, wherein said aligned inner releasing pin opening and said lower releasing pin compartment are for receiving said second push button section of said releasing pin therethrough.

29. A sliding door locking mechanism in accordance with claim 22, wherein said upper and lower pin blocks are the same size and are substantially rectangularly-shaped and are made from a durable plastic molded material.

30. A sliding door locking mechanism in accordance with claim 1, wherein said lever arm has a semi-arc shaped configuration and is made from a thin metal sheet material such as steel, stainless steel or aluminum.

31. A sliding door locking mechanism in accordance with claim 22, wherein each of said tensioning springs are positioned on each of said inner grooved channels of said upper and lower pin blocks, respectively, such that each of said our end sections of said lever arm are received within each of said inner grooved channels and each of said recessed hole openings of said locking pin and said releasing pin, respectively, thereof.

32. A sliding door locking mechanism in accordance with claim 3, wherein said cover slidably snaps onto said push button locking assembly such that each of said first and second push button sections of said locking pin and said releasing pin are received within each of said corresponding locking and releasing pin openings on said top wall of said cover, respectively, therethrough.

33. A sliding door locking mechanism in accordance with claim 8, wherein each of said interior slide channels of said cover are received and snapped onto each of said outer retaining tabs for said base member on said push button housing for enclosing said cover on said push button locking assembly.

34. A sliding door locking mechanism in accordance with claim 12, wherein said opposing mounting openings of said cover are each aligned with each of said corresponding outer shaft member openings of said base member, respectively, for receiving mounting screws therethrough in order to mount said sliding door locking mechanism to a corresponding pair of mounting openings on a stile of a sliding door.

* * * * *